United States Patent [19]

Mulcahy et al.

[11] Patent Number: 4,552,074

[45] Date of Patent: Nov. 12, 1985

[54] PRIMARY SUSPENSION FOR RAILROAD CAR TRUCK

[75] Inventors: Harry W. Mulcahy, Griffith, Ind.; Dimitris Garivaltis, Chicago, Ill.; Stanley Karbowniczek, Chicago, Ill.; Horst T. Kaufhold, Chicago, Ill.

[73] Assignee: AMSTED Industries Incorporated, Chicago, Ill.

[21] Appl. No.: 553,824

[22] Filed: Nov. 21, 1983

[51] Int. Cl.[4] ..... B61F 5/26

[52] U.S. Cl. ..... 105/224.1; 105/222

[58] Field of Search ..... 105/224.1, 223, 222; 267/63 A; 280/687

[56] References Cited

U.S. PATENT DOCUMENTS 2,043,725 6/1936 Anderson ..... 105/224.1 X
3,839,969 10/1974 Thum ..... 105/222 X
4,111,131 9/1978 Bullock ..... 105/224.1

FOREIGN PATENT DOCUMENTS 2309702 9/1974 Fed. Rep. of Germany ... 105/224.1

*Primary Examiner*—Harry Tanner
*Attorney, Agent, or Firm*—Charles E. Bouton; Edward J. Brosius

[57] ABSTRACT

A railway vehicle truck including side frames and wheel sets maintained in a substantially rectangular relationship by resilient connection means at each of the axle mounts to the side frames. The resilient means are prestressed and in equilibrium at each mounting location so as to resist yaw and lengthwise movement of the axles relative to the side frames. The resilient means provide resistance to hunting motion and yet yieldingly permit relative turning of the axle and side frame when the truck traverses a curved track.

4 Claims, 6 Drawing Figures

FIG. 3
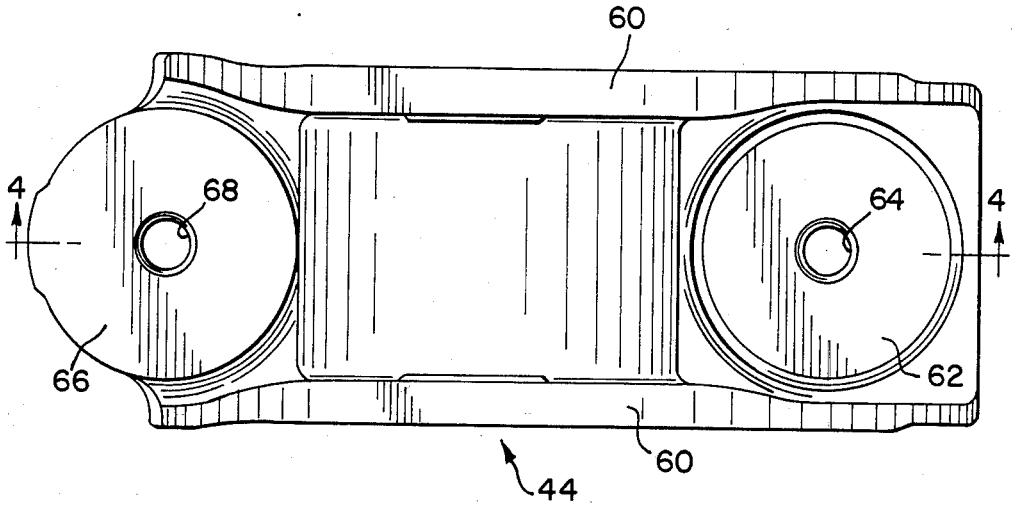
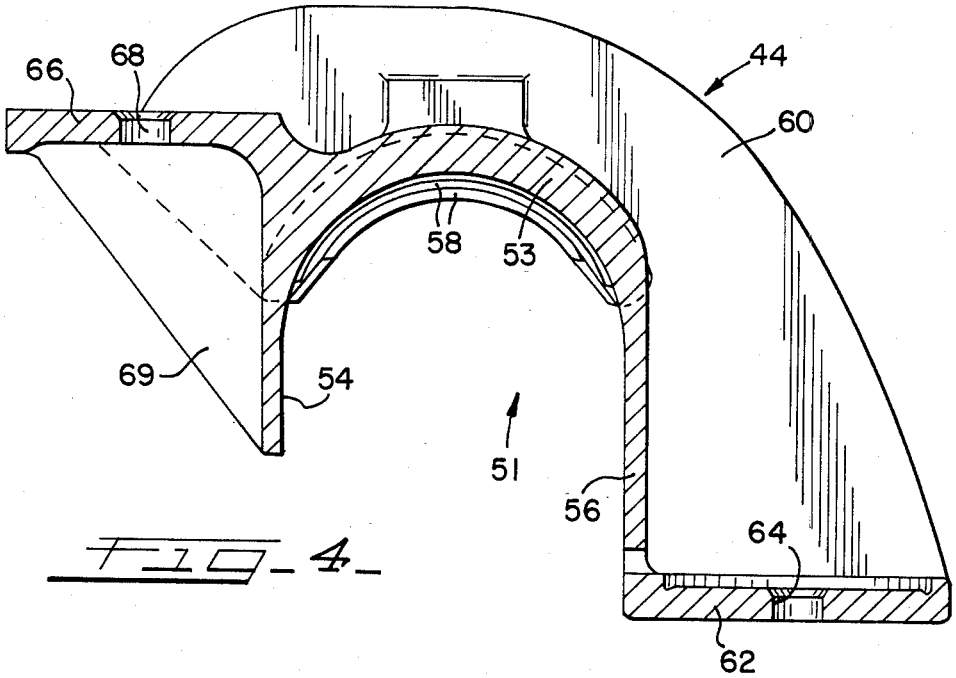
FIG. 4

PRIMARY SUSPENSION FOR RAILROAD CAR TRUCK

FIELD OF THE INVENTION

The present invention relates to railway vehicle trucks and more particularly to a railway vehicle truck structure having improved resistance to hunting.

PRIOR ART

Railway vehicle hunting as used herein is intended to define the uncontrolled swiveling of the railway truck. This swiveling is limited by the wheel flange contact with the rails on which the truck is adapted to ride.

Heretofore the railway vehicle trucks have been constructed such that the two longitudinally spaced wheel sets and the vertical side frame mounted thereon are connected such as to resist movement out of a rectangular relationship. Movement out of the rectangular relationship results in parallelograming or lozenging of the truck components. Such parallelograming or lozenging is characteristic of the hunting action.

In prior truck structures the side frames have been mounted on the wheel sets so as to resist the lozenging by making the connection or mounting of the side frames to the wheel sets resistant to relative turning. One such arrangement utilizes a resilient means disposed between the wheel sets and the side frames at the shaft bearings. The primary function of the resilient members was to permit easier steering around the curves. Thus their stiffness was relatively low and as such of little benefit in controlling undesirable yaw motion.

A reduction of the hunting characteristics of the railway vehicle trucks has been achieved by connecting the lengthwise spaced wheel sets so as to be steerable and connecting the wheel sets by diagonal members which serve to ensure that the wheel sets oscillate out of phase and thereby dampen any hunting oscillations. While such structure is effective to reduce hunting, it also materially increases the weight of the truck. Such weight increase is undesirable for obvious reasons. Moreover the addition of the diagonal steering members to a truck is also costly.

The trucks described in U.S. Pat. No. 3,638,582 and U.S. Pat. No. 4,067,261 are representative of the above described prior art structure.

SUMMARY OF THE INVENTION

By the present invention it is proposed to provide a railway vehicle truck having a resilient member interposed between the wheel sets and the side frames in a manner such that the hunting or yawing is restrained to a greater extent than heretofore.

This is accomplished generally by a railway vehicle truck including a pair of lengthwise spaced wheel sets on which there is mounted a pair of transversely spaced side frames. Disposed between and connected to the wheel sets and each of the side frames are pairs of resilient members. The pairs are each arranged on opposite sides of the respective wheel sets to apply equal and opposite lengthwise restraining forces on the wheel sets and to provide torsional stiffness so as to resist relative turning of the wheel sets and the side frames out of the desired rectangular shape. To this end each of the pairs is pre-stressed relative to the wheel set so that one of the resilient members applies a shear force on one side of said wheel set and the other of the members applies an equal and opposite shear force on the opposite side of the wheel set. Another reason for having the prestressed configuration is to maintain the preload at each axle-side frame connection so as to counteract the inherent creep characteristics of the elastomers. Also, the existence of prestress permits use of practical mounting tolerances, which would not be possible otherwise. The elastomeric pads located at each corner of the truck provide torsional stiffness and thus maintain the wheel sets and side frames square or rectangular while at the same time permitting a steering action so that the truck is capable of negotiating curved trackage.

More specifically the resilient members include a resilient pad adhered and sandwiched between a pair of metal plates and includes means for attaching one of the plates to the side frame and the other of the plates to the wheel set. The plates are attached to the side frame and the wheel sets such that each of the pads disposed between the plates are maintained in shear and provide torsional resistance on the wheel sets. As above explained, the forces are applied in opposition on the wheel sets so as to maintain a substantially squared or rectangular relationship and permit only limited steering of the wheel sets.

BRIEF DESCRIPTION OF THE DRAWINGS

FIG. 3 is a top elevational view of the bearing adapter incorporated in the structure of the present invention.

FIG. 4 is a front elevational view of the bearing adapter.

DESCRIPTION OF THE PREFERRED EMBODIMENT

Figure 1:
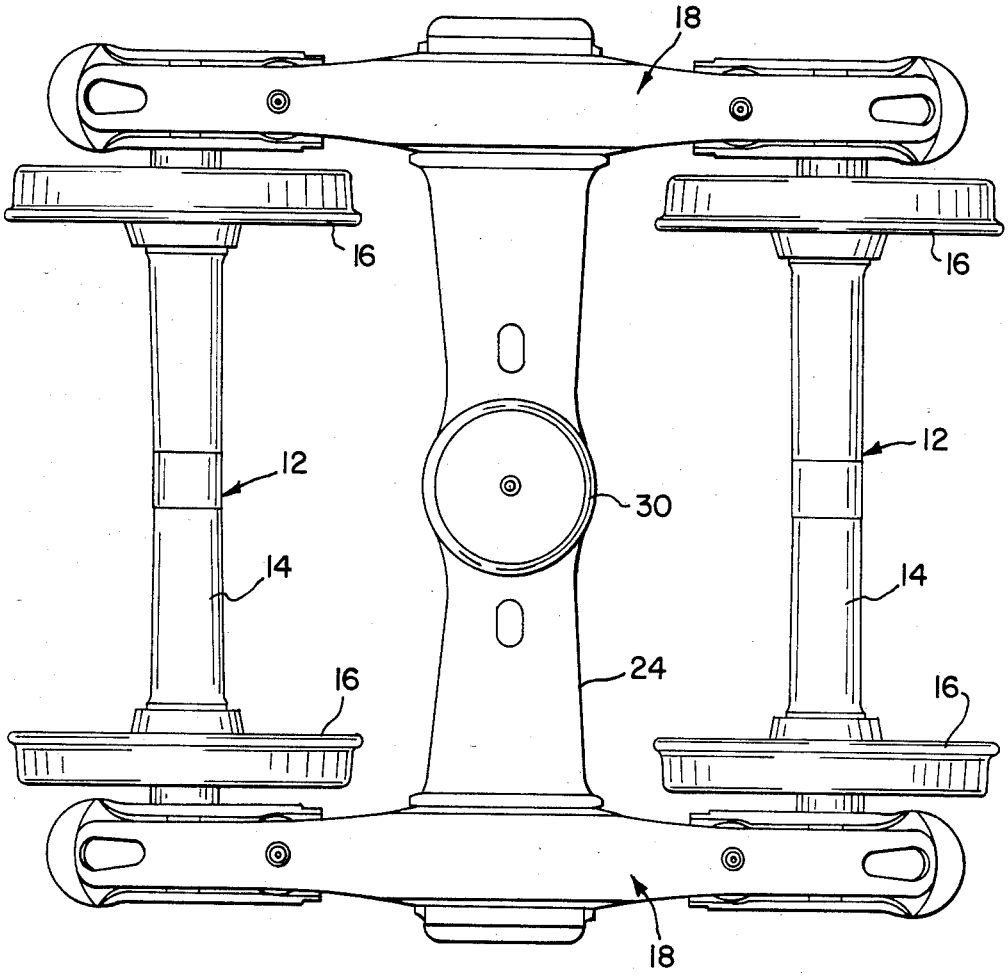
FIG. 1 is a top plan view, of a railway vehicle truck embodying the structure of the present invention.
Figure 2:
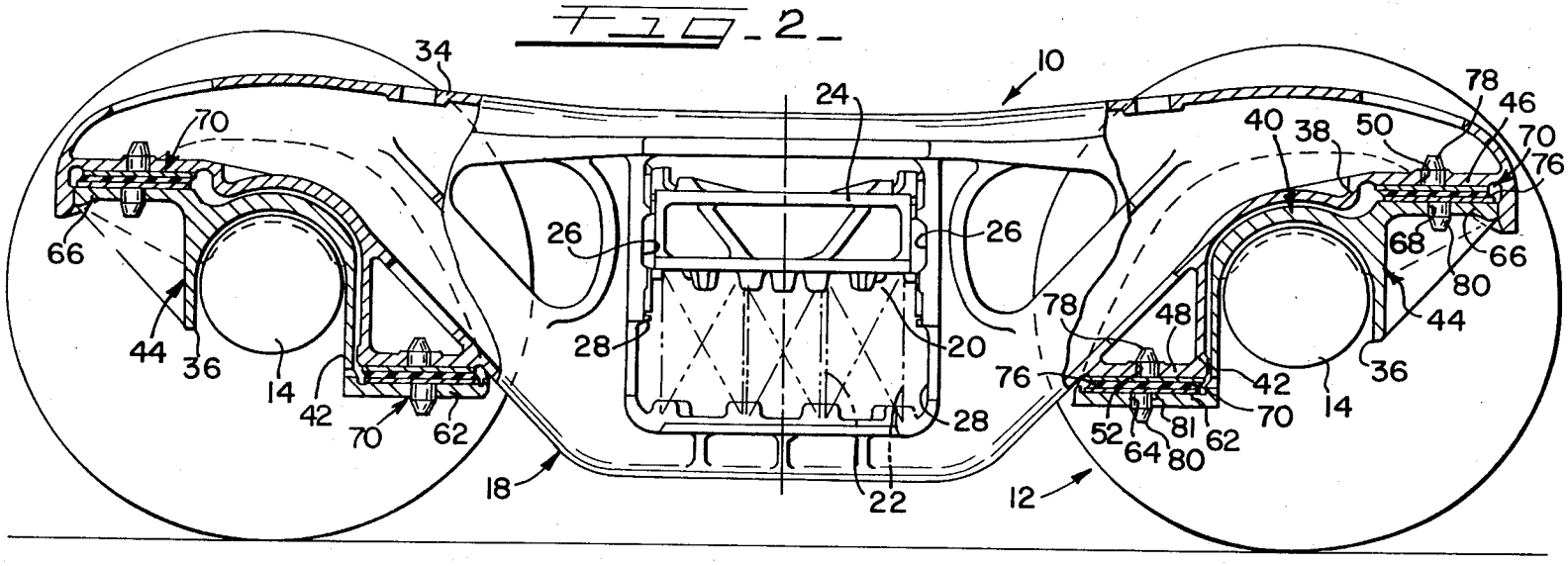
FIG. 2 is a side elevational view, with parts being broken away, of the truck shown in FIG. 1.
Figure 5:
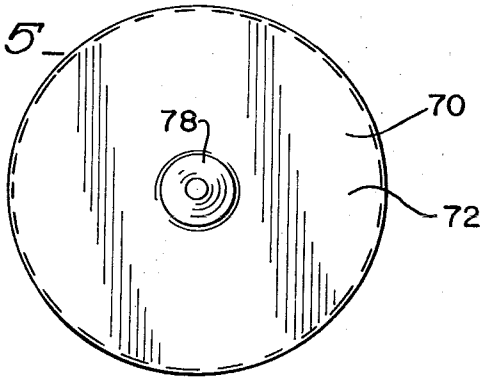
FIG. 5 is a top plan view of one of the resilient members for providing restoring force to the wheel set.

Referring now to the FIGS., in particular FIGS. 1, 2 and 5, there is shown a railway vehicle truck 10 incorporating the anti-hunting or yawing structure of the present invention. The truck 10 comprises generally a pair of lengthwise spaced wheel sets 12 each including an axle 14 having laterally spaced wheels 16 fixed thereon in the standard manner.

A pair of transversely spaced side frames 18 is mounted on the wheel sets 12 as more fully to be described hereinafter. The side frames 18 each include a bolster opening 20 in which there is supported by means of springs 22 the ends of a bolster 24. The bolster 24 action within the side frame is dampened by friction wedges 26 yieldingly held in position by springs 28.

The bolster 24 is of substantially standard construction and includes a center plate 30 which is received within a complementary center plate mounted on a car body (not shown) so that the truck may swivel or turn relative thereto.

The side frames 18 each include a beam 34 extending lengthwise of the truck. The beam 34 is provided at each end thereof with an axle accommodating jaw 36. The jaw 36 comprises an upwardly extending outboard leg 38 which is joined by a bight 40 to a lengthwise spaced inboard leg or wall 42. The legs 38, 42 and bight 40 form in the nature of an open-sided jaw which overlies a bearing adapter 44.

Extending from the leg or wall 38 is an outboard horizontal ledge 46 which is vertically spaced from the center of the wheel axle 14. A lower ledge 48, spaced equidistantly vertically from the center of the axle as the ledge 46, extends from the inboard wall 42. Openings 50 and 52, respectively, are formed in the ledge 46 and ledge 48.

The bearing adapter 44 as shown in FIGS. 2, 3 and 4 is made as a casting and includes a generally inverted U-shaped slot 51 defined by a bight 53 and a downwardly depending outboard wall 54 and inboard wall 56. The bight 53 is formed with a plurality of ribs 58 which seat on the shaft bearing (not shown). Reinforcing ribs 60 are formed along the sides of the adapter and extend from a circular horizontal ledge 62 projecting from the lower end of the wall 56. An axial opening 64 is provided in the circular ledge 62.

Extending from the bight 53 and disposed slightly thereabove is a horizontal generally circular ledge 66. An opening 68 is axially disposed in the ledge 66. Suitable gussetts 69 extend from the outboard wall 54 to support the ledge 66.

As shown in FIG. 2 the opening 68 is lengthwise spaced outboard from the opening 50 in the side frame ledge 46 and the opening 64 is lengthwise spaced inboard of the opening 52. The spacing is significant for reasons which will become apparent hereinafter.

Figure 6:
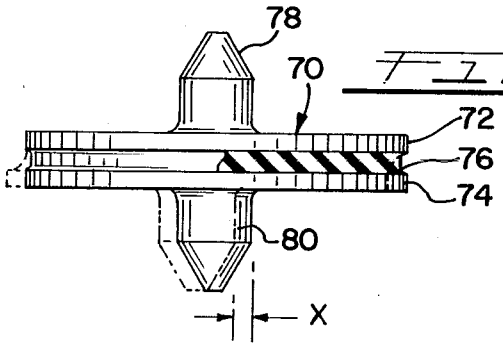
FIG. 6 is an elevational view of the resilient member.

Disposed between the side frame ledge 48 and bearing adapter plate or ledge 62 is one of a plurality of resilient pad assemblies 70. As shown in FIGS. 5 and 6, the pad assemblies 70 each include an upper plate 72 and a lower plate 74 between which there is sandwiched and bonded a resilient or elastomeric pad 76. Projecting from the upper plate 72 is a pin 78 and a similar stud 80 projects from the lower plate 74.

One of the pad assemblies 70, as shown in FIG. 2, is supported on the circular ledge 66 of the bearing adapter 44. In this position the lower plate stud 80 is seated in the opening 68 and the upper plate stud 78 is seated in the opening 50. As heretofore described the openings 50 and 68 are lengthwise axially displaced relative to each other a distance X so that the rubber pad 76 is stressed in shear and applies a force tending to move the wheel shaft 14 inboard.

Another of the pad assemblies 70 is supported on the ledge 62 of the bearing adapter 44. The upper stud 78 seats in the opening 52 of the side frame ledge 48 and the lower stud 80 seats in the opening 64. As heretofore described, the opening 52 is axially offset from opening 64 a distance X equidistant to the distance X between the openings 50 and 68. The resilient pad 94 is thereby stretched to apply a shear force equal and opposite to the force applied by the inboard pad assembly 88 supported on the ledge 62.

The resilient pad assemblies 70 are arranged similarly at each of the four bearing adapters 44 so as to maintain the truck 10 in a generally rectangular relationship. During normal or straight track travel of the truck 10, the equal and opposite forces of the pad assemblies 70 acting on the axles 14 at each of the four corners of the truck will serve to retain the truck in a rectangular relationship until such time as the dynamic forces overcome the equilibrium of the resilient pad 76 forces acting on the wheel sets 12. It is to be noted, however, that the pad assemblies 70 permit limited resilient lateral displacement of the wheel sets 12 relative to the side frames 18. As the truck traverses curved track the wheel sets 12 tend to overcome the resistance of the elastomeric pads and turn relative to the side frames in order to attain a quasi-radial position. Such radial turning, is somewhat restrained by the shear stiffness of the elastomeric pads 76 which serve to return the wheel sets to their squared position. The shear stiffness of the elastomeric pad is so selected as to be effective in restraining hunting of the truck, and yet to permit some degree of turning of the axles when travelling along a curve.

What is claimed is:

1. A railway vehicle truck comprising a pair of longitudinally extending and laterally spaced side frames, a pair of transversely extending and lengthwise spaced wheel sets each having a wheel axle, means for mounting said side frames on said wheel axles so that said truck assumes a normal rectangular position, said mounting means including a pair of elastomeric pads stressed in shear and disposed between said side frames and said axles on opposite sides of each of said respective axles for applying opposing forces on said respective axles to yieldingly resist yaw, longitudinal and lateral movements of axle relative to said side frame thereof while permitting turning of said axles relative to said side frames when said truck traverses curved tracks, one of said pads prestressed lengthwise in one direction and the other of said pads prestressed lengthwise in the opposite direction to create equal and opposite shear forces acting on said axle when said truck assumes a normal rectangular position.

2. The invention as defined in claim 1 wherein an upper plate is bonded to an upper surface of said elastomeric pad and lower plate is bonded to a lower surface of said elastomeric pad, and wherein said upper plate is attached for movement with said side frame and said lower plate is attached for movement with said axle.

3. The invention as defined in claim 2 wherein attachment means are provided for attaching said upper plate to said side frame and attachment means are provided on said lower plate for movement with said axle, said upper and lower plate attachment means being lengthwise displaced so as to stress said elastomeric pad bonded therebetween in shear.

4. The invention as defined in claim 3 wherein said upper attachment means comprises a stud and opening means in said side frame receiving said stud, and, said lower plate attachment means comprises a stud and wherein a bearing adapter is mounted on said axle, said bearing adapter having an opening lengthwise spaced from said side frame opening and receiving said lower plate stud so as to stress said elastomeric pad in shear between said upper and lower plate.

* * * * *